United States Patent [19]

Feugier et al.

[11] Patent Number: 4,936,230

[45] Date of Patent: Jun. 26, 1990

[54] MULTIFUEL HEAT GENERATOR WITH INTEGRATED CIRCULATING BED

[75] Inventors: Alain Feugier, Orgeval; Edmond Perthuis, Viroflay; Marcel Chretien, Morsaung-sur-Orge; Alexandre Petrovic, Chatou, all of France

[73] Assignee: Institut Francais du Petrole, Rueil-Malmaison, France

[21] Appl. No.: 269,770

[22] PCT Filed: Dec. 23, 1987

[86] PCT No.: PCT/FR87/00511

§ 371 Date: Oct. 21, 1988

§ 102(e) Date: Oct. 21, 1988

[87] PCT Pub. No.: WO88/05144

PCT Pub. Date: Jul. 14, 1988

[30] Foreign Application Priority Data

Dec. 24, 1986 [FR] France ..... 86 18259

[51] Int. Cl.[5] ..... F23B 7/00

[52] U.S. Cl. ..... 110/234; 110/245; 122/4 D

[58] Field of Search ..... 122/4 D; 110/245, 233, 110/234; 165/104.16

[56] References Cited

U.S. PATENT DOCUMENTS 4,499,857 2/1985 Wormser ..... 122/4 D
4,665,864 5/1987 Seshamani et al. ..... 122/4 D

FOREIGN PATENT DOCUMENTS 2159432 12/1985 United Kingdom ..... 122/4 D

*Primary Examiner*—Edward G. Favors
*Attorney, Agent, or Firm*—Antonelli, Terry, Stout & Kraus

[57] ABSTRACT

Heat generator comprising a combustion chamber, a circulating bed and a recovery boiler. The circulating bed and the combustion chamber have a common wall. The present invention may be used to achieve the combustion of high sulphur content fuels.

9 Claims, 2 Drawing Sheets

MULTIFUEL HEAT GENERATOR WITH INTEGRATED CIRCULATING BED

BACKGROUND OF THE INVENTION

The subject of the invention is a heat generator able to burn high-sulfur fuels and which, in the form of a compact assembly, enables the production of useful heat to be separated from the desulfurization of the flue gases.

Strict regulations in protected zones govern emissions of sulfur oxides in the gaseous effluents from heat generators and forbid the use of high-sulfur fuels which, however, have definite economic advantages: this is the case for certain coals related to lignites, and for oil residues from refining processes.

Aside from downstream processes for treating fumes which generally apply to very-high-power facilities, in certain fossil-fuel-burning thermal units desulfurization is accomplished in the course of combustion by directly injecting a calcium-based absorbent (limestone, lime, dolomite, etc.) into the hearth.

This in situ desulfurizing process is considered principally for solid fuels, and its efficiency (between 30 and 60%) is a great contributor to the temperature distribution in the combustion chamber, while requiring substantial lime consumption (Ca/S ratio=Calcium/Sulfur ratio on the order of 3 to 4 moles/mole).

A different method consists of using so-called "dry ash" fluidized-bed boilers which operate at about 800°-900° C. and in which fuel and absorbent are placed in intimate contact.

In particular, within a "fast" or "circulating" fluidized bed having systematic recirculation of the solid particles, a very high rate of desulfurization can be obtained (85-90%) with relatively modest Ca/S ratios (1.5 to 2 moles/mole).

However, the self-desulfurizing circulating-bed heat generator poses a number of technological problems.

In particular, its reliability is closely linked to the strength of heat-exchanging tube bundles and to abrasion and corrosion phenomena.

The device proposed has the essential advantage of being reliable since it can be implemented by using tested techniques. Moreover, the generator according to the present invention is compact and takes up very little space.

The basic idea is based on the combination of three principal elements arranged such that the exchange surfaces are protected from the rapid flow of solid particles which are often the cause of rapid deterioration of these surfaces.

Thus, the generator proposed consists essentially of a hearth or combustion chamber, preferably with cold walls, a recovery boiler capturing the sensible heat of the flue gases, and an intermediate circulating bed with an insignificant internal exchange surface, whose function is to desulfurize the gases passing between the hearth upstream and the exchanger downstream.

"Cold wall" is understood herein to mean that the wall has means for extracting heat.

In general, the present invention relates to a great generator with a combustion chamber, a circulating bed, and a recovery boiler. According to the present invention, the circulating bed and combustion chamber have a common wall.

This common wall may have at least one orifice for feeding into the circulating bed a stream of primary fluid and/or at least one orifice for feeding into the circulating bed a stream of secondary fluid.

This common wall may be a cold wall. Likewise, other walls of the combustion chamber may be cold walls.

The various cold walls may have provision for circulation of a fluid.

According to the present invention, the circulating bed and the recovery boiler may have a common wall.

Likewise, the combustion chamber and the recovery boiler may have a common wall.

The walls of the circulating bed may have a coating made of a heat-insulating material.

The desulfurizing circulating bed whose entrained solid material is essentially, the absorbent, uses the hot gases coming from the hearth as a working fluid.

Since the temperature of the gases may vary with the generator load, the bed may be maintained at the optimum desulfurizing temperature (800°-900° C.) by injecting a makeup fuel into the reactor, whereby combustion takes place with the excess oxygen from the upstream hearth, possibly with additional fresh fuel.

The compactness of the generator according to the invention is achieved by original spatial distribution of the three main elements disposed vertically. This compactness facilitates its prefabrication. The present invention will be better understood and its advantages will emerge more clearly from the description hereinbelow of particular non-limitative examples illustrated by the attached figures.

DETAILED DESCRIPTION

Figure 1:
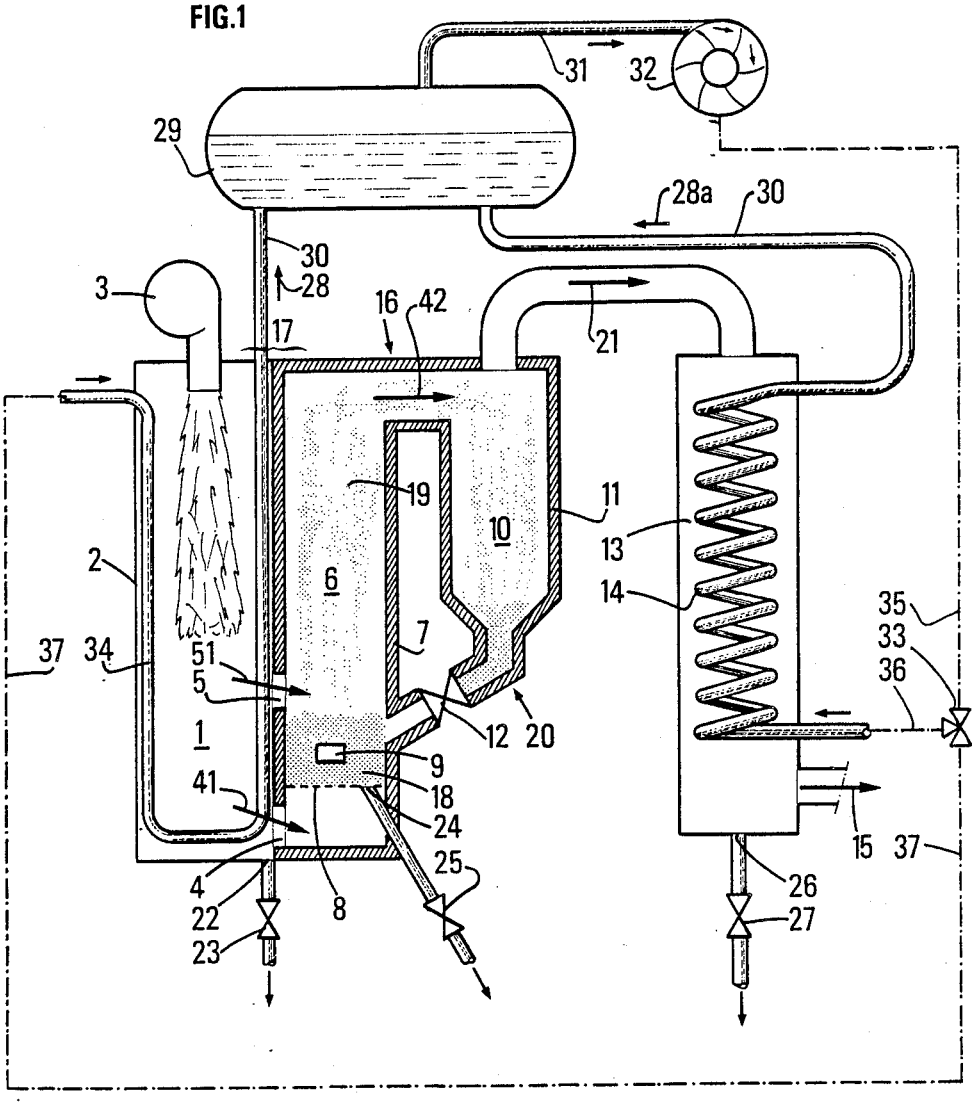
FIG. 1 illustrates the general layout of the heat generator according to the invention.

The principle of the compact self-desulfurizing unit according to the invention is illustrated by FIG. 1, which shows a particular example adapted to combustion of a solid or liquid fuel injected in the powder form into the upstream hearth or combustion chamber.

Combustion chamber or hearth 1 is preferably cold-walled, whereby exchange surfaces 2 are for example of the "diaphragm wall" type, i.e. the fluid circulating means are associated and/or integrated with the walls of the combustion chamber. These cold walls are sized such that the temperature of the combustion gases at the end of the hearth may be in the range of 600°-850° C. for all operating modes.

Burner 3 may advantageously be a "low $NO_x$ emitting" burner to limit nitrogen oxide emissions and contribute to making the generator completely non-polluting.

Under these conditions, the excess air or excess fuel can be regulated such that the quantity of residual oxygen is at least equal to that necessary to effect the second combustion in circulating bed 16, which has a reactor 6 and a separator 10 which may be of the cyclone type.

Reactor 6 of circulating bed 16 is joined to hearth 1 by a common wall 17, communication between these two elements being accomplished directly by one or more passages provided in this wall. The stream 41 of primary gas supplying the circulating bed and coming from combustion chamber 1 enters through lower passage 4, while the stream of secondary gas enters through upper passage 5.

The internal walls 7 are made of a layer of refractory insulating material which may be thin abrasion-resistant and the heat losses are essentially recovered by the heat-conducting fluid which bathes the jacket of hearth 1.

In the example of FIG. 1, auxiliary fuel and/or the material absorbing sulfur oxides is/are injected through at least one orifice 9 in the lower part of reactor 6, which is the dense phase of the circulating bed. However, it will not be a departure from the scope of the invention to inject these products at another point in the circulating loop of the circulating bed, particularly by injecting one or both products into return leg 20.

The oxidizing gases or fumes 41 and 51 coming from the lower 4 and upper 5 passages defined above and serving as a working fluid and comburant for the circulating bed are injected on either side of the dense phase 18 of this bed.

The gases or fumes in primary stream 41 penetrate into dense phase 18 via a perforated grid 8 or any other device ensuring good distribution of the gases throughout the fluidized solids.

The gases or fumes in secondary stream 51 are injected into the transition zone or diluted zone of reactor 19, also known as the release zone. They may also be distributed through several orifices in a straight cross section or stepped cross sections relative to the circulating axis in reactor 6. The same applies to the introduction of the primary stream.

Controlled distribution by appropriate means such as fume flaps between primary stream 41 and secondary stream 51 allows the progress of combustion in reactor 6 to be controlled and the flow of solids swept outside dense zone 18 to be sent to recycling.

This recycling is effected by means of separator 10 which can conveniently be a cyclone as stated above. The recirculation rate is governed by a valve device 12 which may be of mechanical or hydraulic design, for example a fluidized siphon or "L valve."

The assembly of reactor 6, cyclone 10, and link leg 20, which constitutes desulfurizing circulating bed 16, is heat-protected by refractory insulating coatings 7 and 11.

The desulfurized gases 21 leave the upper part of separator 10 to feed recovery boiler 13 and give up heat energy to exchange surfaces 14 which may be made of tube bundles.

The fumes are finally evacuated via pipe 15 and sent to the filtration system not shown in the diagram, which may be of a type known to the individual skilled in the art.

The solid waste which has not been recycled or which has escaped separator 10 of circulating bed 16 may be drawn off at the bottom of the combustion chamber through orifice 22 which may be blocked by a valve 23, at the bottom of dense phase 18 of the circulating bed at the level of grid 8, through orifice 24 which may have a valve 25, and/or the bottom of the recovery boiler through orifice 26 which may be blocked by valve 27.

In the embodiment shown in FIG. 1 which relates to production of non-superheated steam, the heat-conducting fluid 28 such as a water-steam emulsion coming from the combustion chamber is sent to a pressurized container or tank 29 through a line 30. This tank, located at the top of the generator in the example of FIG. 1, also receives in this example water-steam emulsion **28*a* coming from recovery boiler 13 through line 30. The fluid stored in container 29 is transferred in the form of steam via a line 31 to a consumer system such as a turbine 32, a heating system, etc. The heat-conducting fluid, after giving up part of its energy and after condensation in a condenser not shown, is distributed by a valve means 33 between the heat-conducting fluid feed to tube bundles 14 of recovery boiler 13 and the heat-conducting fluid feed of the circuit bathing combustion chamber 1**, whereby said circuit may have pipes forming an integral part of the walls of this combustion chamber or may be formed by a sheet of water.

The heat-conducting fluid is carried between the outlet of turbine 32 and valve 33 and the feed to tube bundles 14 and pipe 34 by pipes 35, 36, and 37 shown at least partially in dot-dashed lines. Of course, these pipes can be heat-insulated.

Figure 2:
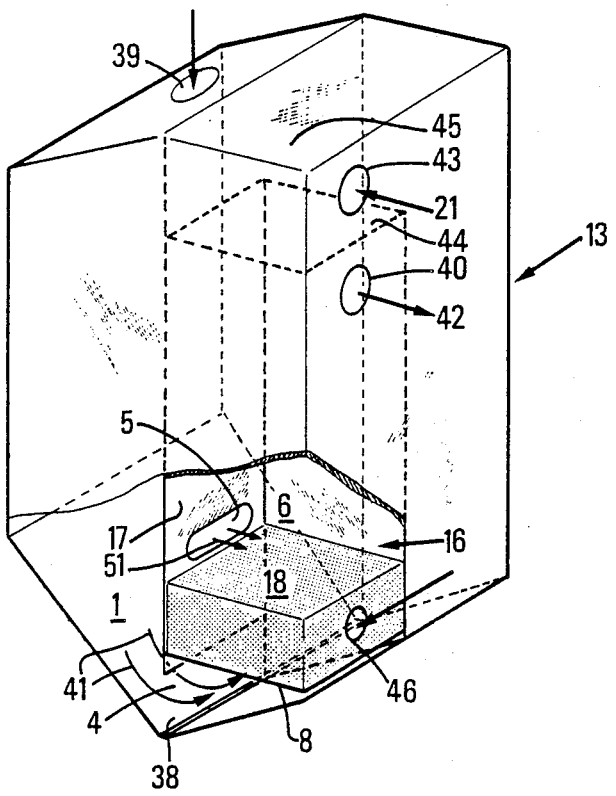
FIG. 2 is a simplified perspective view of such a heat generator.

FIG. 2 shows an example of the practical implementation of a unit wherein optimum compactness has been achieved by setting hearth 1, reactor 6 of circulating bed 16, and recovery boiler 13 edge-to-edge.

The straight sections of these component parts are rectangular (see FIG. 3), which allows them to have close thermal contact with each other and minimizes fatal losses from the walls to the surrounding environment.

In FIG. 2, wall 17 is interrupted before reaching the lower part 38 of hearth 1 and the reactor of circulating bed 6, thus allowing simple creation of lower passage 4.

This figure does not show the cyclone, the heat-conducting fluid circulating pipes, or the burner.

Reference 39 designates the orifice allowing burner 3 to be set in place (FIG. 1).

Orifice 40 designates the outlet orifice from reactor 6 of the circulating flow 42 proceeding toward separator 10.

Reference 43 designates the inlet orifice for gases 21 coming from separator 10 and proceeding toward recovery boiler 13 (FIG. 1).

In the embodiment shown in FIG. 2, circulating bed 6 is not extended heightwise in the same way as hearth 1, but is interrupted in the front by wall 44. The latter is surmounted by a parallelepipedic casing 45 in direct communication with recovery boiler 13 which is also parallelepipedic in shape.

Orifice 46 corresponds to the link of leg 20 (FIG. 1) connecting separator 10 (FIG. 1) to the reactor of circulating bed 6 (FIG. 1).

Figure 3:
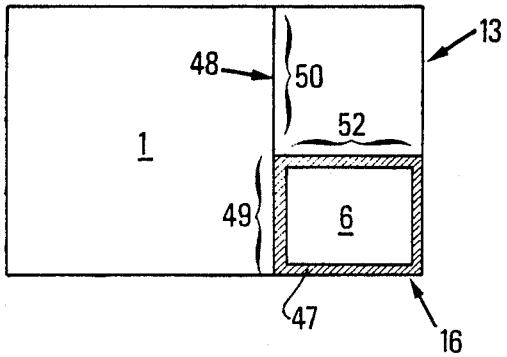
FIGS. 3 and 4 show two particular versions of the arrangement of the various elements of the heat generator.

FIG. 3 represents a cross section at the level of the reactor of the circulating bed of the generator shown in FIG. 2.

In this FIG. 3 we see that reactor 6 of circulating bed 16 is thermally isolated on its four faces by the material designated by reference 47. The combustion chamber has a plane wall 48 common to both reactor 6 of the circulating bed at 49 and to the recovery boiler at 50.

Recovery boiler 13 and reactor 6 of the circulating bed have a common wall 52 which is substantially perpendicular to plane wall 48.

Figure 4:
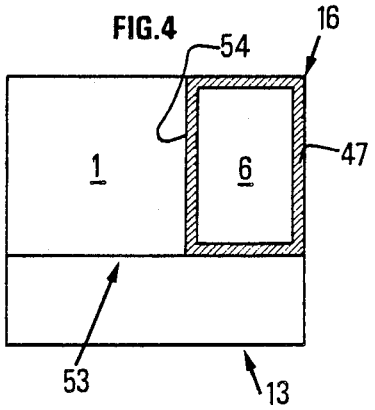

FIG. 4 represents an alternate version of the device according to the invention wherein it is the recovery boiler 13 which has a plane wall 53 common to both hearth 1 and reactor 6 of the circulating bed.

Reference 54 designates the wall common to hearth 1 and reactor 6, whereby this wall can be substantially perpendicular to plane wall 53 of the boiler.

In FIG. 1, valve 33 can be controlled bearing in mind the power demand from turbine 32, the quantity of fuel consumed by burner 3, and/or the temperature of reactor 6 of the circulating bed.

Introduction of an auxiliary fuel into the circulating bed at 9 for example, although not essential, permits more flexible control of the temperature of the circulating bed.

We claim:

1. Heat generator comprising a combustion chamber, a circulating bed, and a recovery boiler, a common wall means disposed between said circulating said bed and said combustion chamber, at least one first passage means provided in said common wall means for supplying primary gas from the combustion chamber to the circulating bed, and at least one second passage means disposed in said common wall means at a position higher than said first passage means for supplying a stream of secondary gas, whereby oxidizing gases from said first and second passage means serve as a working fluid and comburent for the circulating bed.

2. A heat generator according to claim 1, wherein said common wall means includes a cold wall.

3. A heat generator according to claim 2, wherein said combustion chamber includes a cold-wall.

4. Generator according to one of claims 2 or 3, wherein said cold walls includes means for circulating a fluid.

5. Generator according to claim 3, wherein a common wall means is provided between said circulating bed and said recovery boiler.

6. Generator according to claim 5, wherein common wall means are provided between said combustion chamber and said recovery boiler.

7. Generator according to claim 6, wherein walls of the circulating bed have a coating made of a heat-insulating material.

8. Generator according to claim 1, wherein a common walls means is provided between said circulating bed and said recovery boiler.

9. Generator according to one of claims 1 or 8, wherein common wall means are provided between said combustion chamber and said recovery boiler.

* * * * *